US009396659B2

(12) United States Patent
Langgood et al.

(10) Patent No.: US 9,396,659 B2
(45) Date of Patent: Jul. 19, 2016

(54) COLLISION AVOIDANCE AMONG VEHICLES

(71) Applicant: LENOVO ENTERPRISE SOLUTIONS (SINGAPORE) PTE. LTD., Singapore (SG)

(72) Inventors: John K. Langgood, Cary, NC (US); Thomas F. Lewis, Raleigh, NC (US); Kevin M. Reinberg, Chapel Hill, NC (US); Kevin S. D. Vernon, Durham, NC (US)

(73) Assignee: Lenovo Enterprise Solutions (Singapore) Pte. Ltd., Singapore (SG)

( * ) Notice: Subject to any disclaimer, the term of this patent is extended or adjusted under 35 U.S.C. 154(b) by 236 days.

(21) Appl. No.: 14/103,966

(22) Filed: Dec. 12, 2013

(65) Prior Publication Data

US 2015/0170519 A1 Jun. 18, 2015

(51) Int. Cl.
*G08G 1/16* (2006.01)

(52) U.S. Cl.
CPC ..... *G08G 1/164* (2013.01); *G08G 1/163* (2013.01)

(58) Field of Classification Search
CPC ..... G08G 1/161; G08G 1/162; G08G 1/163; G08G 1/164; G08G 1/166; G08G 1/22
See application file for complete search history.

(56) References Cited

U.S. PATENT DOCUMENTS

| | | | |
|---|---|---|---|
| 6,275,773 | B1 | 8/2001 | Lemelson |
| 2012/0130629 | A1 | 5/2012 | Kim |
| 2013/0018572 | A1 | 1/2013 | Jang |

FOREIGN PATENT DOCUMENTS

| | | | |
|---|---|---|---|
| CN | 102039866 | A | 5/2011 |
| EP | 1 540 564 | B1 | 10/2009 |
| EP | 2 311 017 | B1 | 3/2013 |

OTHER PUBLICATIONS

Gupta, C.D., "Application of GPS and Infrared for Car Navigation in Foggy Condition to Avoid Accident", 2010 Second International Conference on Computer Engineering and Applications (ICCEA), Mar. 19-21, 2010, pp. 238-241, (vol. 2), IEEE Xplore, USA, DOI: 10.1109/ICCEA.2010.289.

Anonymous, "Navigation Negotiations for Autonomous Vehicles", Technical Disclosure, Jul. 27, 2012, pp. 1-6, IP.com Prior Art Database (online publication), IP.com No. IPCOM000220438D, URL: http://ip.com/IPCOM/000220438.

*Primary Examiner* — Mussa A Shaawat
*Assistant Examiner* — Kyung Kim
(74) *Attorney, Agent, or Firm* — Edward J. Lenart; Katherine S. Brown; Kennedy Lenart Spraggins LLP

(57) ABSTRACT

Collision avoidance among vehicles that each include a management module coupled to other management modules and a central database manager, includes: establishing, by management modules of a set of traveling vehicles having a location within a predefined area, a collision zone including a network of the management modules of the traveling vehicles; and sharing, within the collision zone, dynamic information describing the traveling vehicles; retrieving, from the central database manager, static information describing the traveling vehicles; detecting, by a management module of a first vehicle in the collision zone, a potential collision with a second vehicle in the collision zone in dependence upon the dynamic and static information; and controlling, by the management module of the first traveling vehicle, the first traveling vehicle to take evasive action in dependence upon the dynamic and static information describing the first and second traveling vehicle.

15 Claims, 4 Drawing Sheets

COLLISION AVOIDANCE AMONG VEHICLES

BACKGROUND OF THE INVENTION

1. Field of the Invention

The field of the invention is data processing, or, more specifically, methods, apparatus, and products for collision avoidance among vehicles.

2. Description of Related Art

Rain, fog, smoke, and other elements cause visibility problems for drivers on roadways every day. These elements cause visibility to be reduced and the likelihood of a pileup to increase. Also, even without these conditions, a driver's judgment can be impaired by various factors, such as alcohol, medication, conversation, and the like. This impairment causes numerous traffic accidents. Many times these accidents result in serious injury and/or death.

SUMMARY OF THE INVENTION

Methods, apparatus, and products for collision avoidance among vehicles are disclosed in this specification. Each vehicle includes a management module that is coupled for data communications to other management modules and to a central database manager. Collision avoidance according to embodiments of the present invention includes: establishing, by management modules of a set of traveling vehicles having a location within a predefined area, a collision zone including a data communications network of the management modules of the traveling vehicles; sharing, amongst the management modules of the collision zone, dynamic information describing the traveling vehicles; retrieving, by each of the management modules of the collision zone from the central database manager, static information describing the traveling vehicles; detecting, by a management module of a first traveling vehicle in the collision zone, a potential collision with a second traveling vehicle in the collision zone in dependence upon the dynamic and static information describing the first and second traveling vehicle; and controlling, by the management module of the first traveling vehicle, the first traveling vehicle to take evasive action in dependence upon the dynamic and static information describing the first and second traveling vehicle.

The foregoing and other objects, features and advantages of the invention will be apparent from the following more particular descriptions of exemplary embodiments of the invention as illustrated in the accompanying drawings wherein like reference numbers generally represent like parts of exemplary embodiments of the invention.

DETAILED DESCRIPTION OF EXEMPLARY EMBODIMENTS

Figure 1:
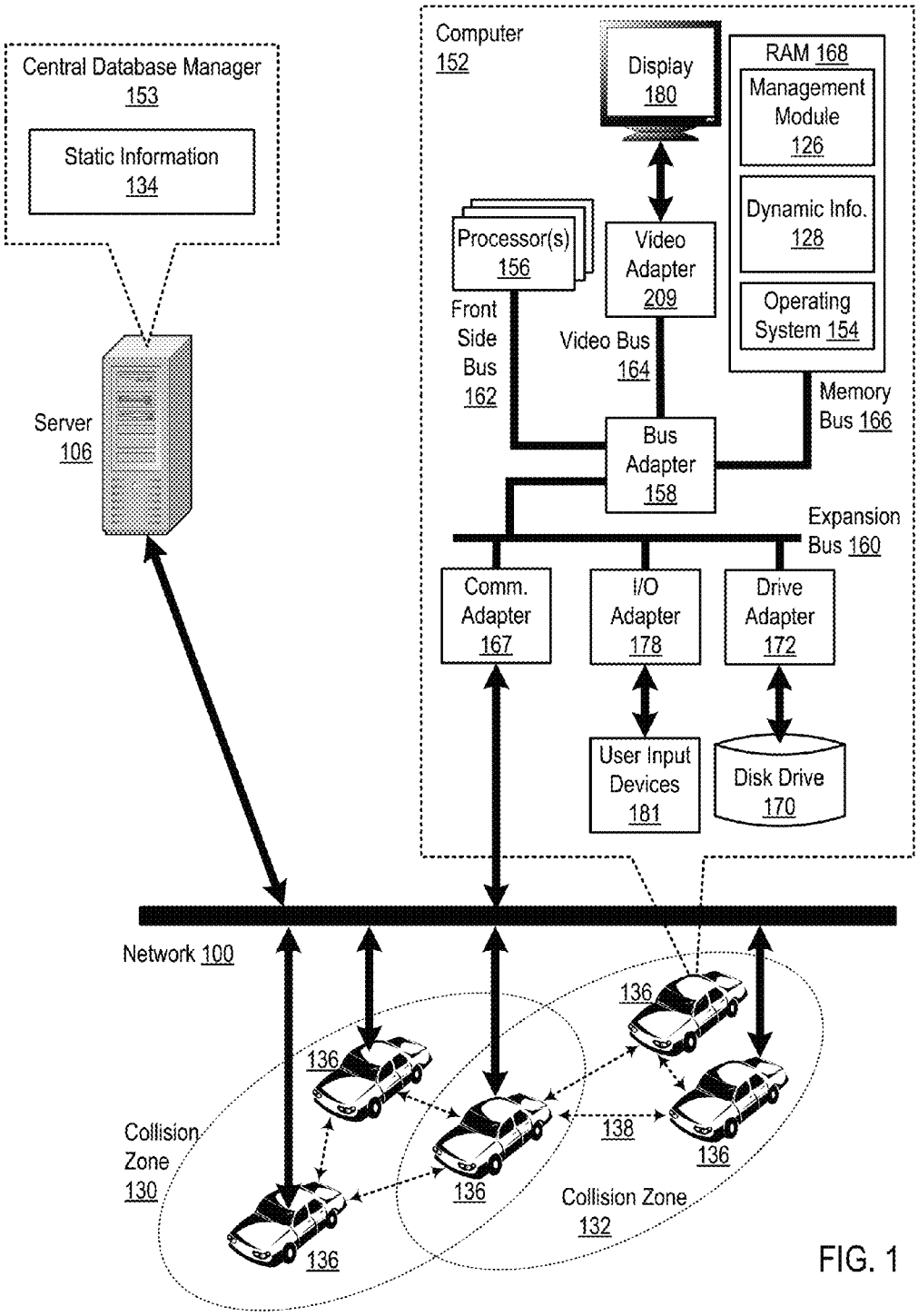
FIG. 1 sets forth a network diagram of a system for collision avoidance among vehicles according to embodiments of the present invention.

Exemplary methods, apparatus, and products for collision avoidance among vehicles in accordance with the present invention are described with reference to the accompanying drawings, beginning with FIG. 1. FIG. 1 sets forth a network diagram of a system for collision avoidance among vehicles according to embodiments of the present invention. The system of FIG. 1 includes a number of vehicles (136). Each vehicle includes automated computing machinery in the form of an example computer (152).

The computer (152) of FIG. 1 includes at least one computer processor (156) or 'CPU' as well as random access memory (168) ('RAM') which is connected through a high speed memory bus (166) and bus adapter (158) to processor (156) and to other components of the computer (152).

The computer (152) of FIG. 1 includes disk drive adapter (172) coupled through expansion bus (160) and bus adapter (158) to processor (156) and other components of the computer (152). Disk drive adapter (172) connects non-volatile data storage to the computer (152) in the form of disk drive (170). Disk drive adapters useful in computers configured for collision avoidance among vehicles according to embodiments of the present invention include Integrated Drive Electronics ('IDE') adapters, Small Computer System Interface ('SCSI') adapters, and others as will occur to those of skill in the art. Non-volatile computer memory also may be implemented for as an optical disk drive, electrically erasable programmable read-only memory (so-called 'EEPROM' or 'Flash' memory), RAM drives, and so on, as will occur to those of skill in the art.

The example computer (152) of FIG. 1 includes one or more input/output ('I/O') adapters (178). I/O adapters implement user-oriented input/output through, for example, software drivers and computer hardware for controlling output to display devices such as computer display screens, as well as user input from user input devices (181) such as keyboards and mice. The example computer (152) of FIG. 1 includes a video adapter (209), which is an example of an I/O adapter specially designed for graphic output to a display device (180) such as a display screen or computer monitor. Video adapter (209) is connected to processor (156) through a high speed video bus (164), bus adapter (158), and the front side bus (162), which is also a high speed bus. The exemplary computer (152) may also include various other components not shown here such as an altimeter, an accelerometer, a compass, a GPS (Global Positioning Satellite) receiver, and so on.

The exemplary computer (152) of FIG. 1 includes a communications adapter (167) for data communications with other computers (182) and for data communications with a data communications network (100). Such data communications may be carried out serially through RS-232 connections, through external buses such as a Universal Serial Bus ('USB'), through data communications networks such as IP data communications networks, and in other ways as will occur to those of skill in the art. Communications adapters implement the hardware level of data communications through which one computer sends data communications to another computer, directly or through a data communications network. Examples of communications adapters useful in computers configure for collision avoidance among vehicles according to embodiments of the present invention include modems for wired dial-up communications, Ethernet (IEEE 802.3) adapters for wired data communications, and 802.11 adapters for wireless data communications. Other example protocols which may be supported by the communication adapter include: GSM (Global System For Mobile Communications) and CDMA (Code Division Multiple Access) protocols.

In the example of FIG. 1, each of the vehicles (136) is coupled for data communications to several other vehicles and to a central database manager (153). In the example of FIG. 1, the vehicles are depicted as being coupled to one another for data communications through a point-to-point network (138) for clarity of description only, not limitation. In other embodiments, the vehicles (136) may be coupled for data communications through a cellular network, such as a GSM or CDMA based network.

Stored in RAM (168) is a management module (126), a module of computer program instructions that, when executed by the processor (156), causes the computer (152) to operate for collision avoidance in accordance with embodiments of the present invention. Each management module (126) in the example of FIG. 1 may register the management module's vehicle (136) with the central database manager (153). Registering the vehicle with the central database manager (153) may include providing Vehicle Identification Number (VIN) or make and model information to the central database manager (153). The central database manager (153) may then maintain static information (134) describing each registered vehicle. Static information describing a vehicle is any information regarding a vehicle that will not or is unlikely to change. Examples of such static information may include: vehicle dimensions, structural information such as crumple zones or the strongest impact point, the vehicle owner's driving history, the present condition of vehicle including tire wear, brake conditions, or service records, factory determined braking performance characteristics indicating distance required for the vehicle to come to a complete stop once applying brakes at various speeds in various roadway conditions, average or typical performance characteristics such as torque, acceleration, average fuel consumption, and the like.

The central database manager (153) may retrieve such static information from websites, from vehicle manufacturer's databases, from a vehicle directly, from a user providing the information as part of populating the database, and so on as will occur to readers of skill in the art.

In addition to static information (134) maintained by the central database manager (153), each management module, while traveling, collects, in real-time, dynamic information (128) describing the management module's vehicle. Dynamic information as the term is used in this specification refers to any information relevant to a vehicle that is not standard or is likely to change in a short period of time. Examples of such dynamic information (128) include a vehicle's speed, a vehicle's direction of travel, a vehicle's location, a vehicle's current operational characteristics such whether the exterior or interior lights are turned on, whether the radio is turned on, and the like, a vehicles sensor data such as tire pressure information, passenger information including the number of passengers inside the vehicle and seating position of each passenger, the current weight of the car with passengers, and so on as will occur to readers of skill in the art.

While traveling, the management modules (126) of a set of traveling vehicles having a location within a predefined area may establish a collision zone. A collision zone as the term is used in this specification is a data communications network of the management modules of the vehicles traveling within a predefined area. In the example of FIG. 1, five vehicles (136) form two collision zones (130, 132). Each collision zone (130, 132) includes three of the five vehicles such that at least one vehicle (136) is included in both collision zones.

The management modules (126) of the travelling vehicles within the same collision zone, share dynamic information (128) describing the traveling vehicles. In the example of FIG. 1, the vehicles in collision zone (132) share dynamic information (126) with one another while the vehicles in the collision zone (130) share dynamic information (126) with one another.

Each of the management modules (126) may also retrieve, from the central database manager (153), static information (134) describing the traveling vehicles within the same collision zone. In this way, each management module of a vehicle within a particular collision zone is aware of all available data describing the other vehicles within the same collision zone (130, 132).

With such knowledge a first traveling within a collision zone (132, for example) may detect a potential collision with a second traveling vehicle in the same collision zone (132). That is, a management module (126) of one vehicle may detect a potential collision with another vehicle in the same collision zone (132) based on the dynamic and static information describing the first and second traveling vehicle. For example, a first vehicle may detect a potential collision by determining that a second vehicle within the collision zone is located a short distance directly in front of the first vehicle in a roadway, travelling in the same directly, but has suddenly stopped.

The management module (126) of the first vehicle (136) may then control the first traveling vehicle to take evasive action in dependence upon the dynamic and static information describing the first and second traveling vehicle. That is utilizing the knowledge of location, speed, direction and other dynamic and static data, the management module of the first vehicle may alter the course of or otherwise control the first vehicle to take evasive action. Evasive action as the term is used in this specification refers to various actions taken to attempt to avoid a collision, alert a driver of the potential collision, or reduce the effect of the collision if the collision is unavoidable.

Also stored in RAM (168) is an operating system (154). Operating systems useful in computers configured for collision avoidance among vehicles according to embodiments of the present invention include UNIX™, Linux™, Microsoft XP™, AIX™, IBM's i5/OS™, and others as will occur to those of skill in the art. The operating system (154) and management module (126) in the example of FIG. 1 are shown in RAM (168), but many components of such software typically are stored in non-volatile memory also, such as, for example, on a disk drive (170).

The arrangement of vehicles, databases, and other devices making up the exemplary system illustrated in FIG. 1 are for explanation, not for limitation. Data processing systems useful according to various embodiments of the present invention may include additional servers, routers, other devices, and peer-to-peer architectures, not shown in FIG. 1, as will occur to those of skill in the art. Networks in such data processing systems may support many data communications protocols, including for example TCP (Transmission Control Protocol), IP (Internet Protocol), HTTP (HyperText Transfer Protocol), WAP (Wireless Access Protocol), HDTP (Handheld Device Transport Protocol), and others as will occur to those of skill in the art. Various embodiments of the present invention may be implemented on a variety of hardware platforms in addition to those illustrated in FIG. 1.

Figure 2:
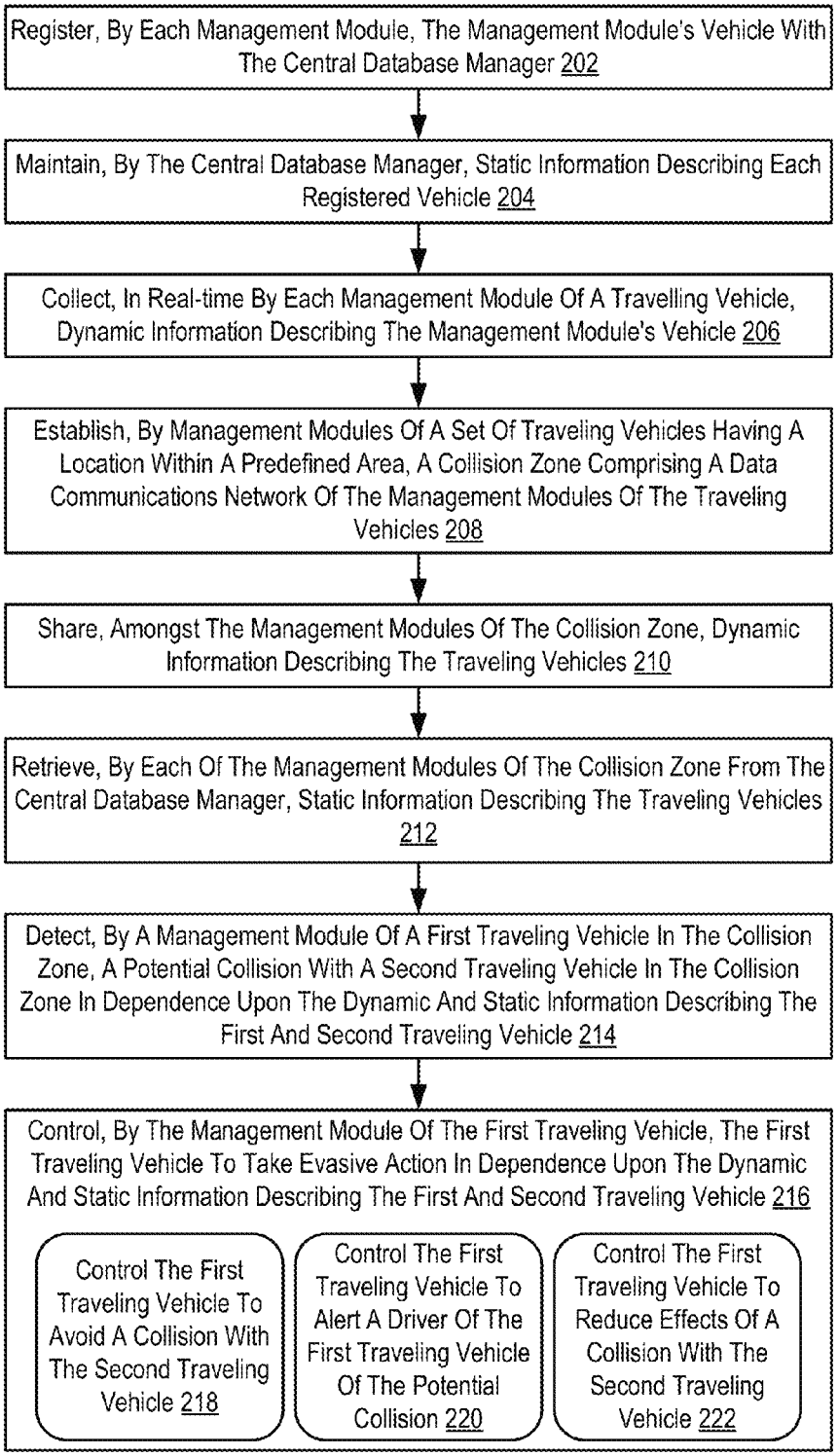
FIG. 2 sets forth a flow chart illustrating an exemplary method for collision avoidance among vehicles according to embodiments of the present invention.

For further explanation, FIG. 2 sets forth a flow chart illustrating an exemplary method for collision avoidance among vehicles according to embodiments of the present invention. Each vehicle includes a management module coupled, for data communications, to other management modules and to a central database manager similar to those depicted in the example of FIG. 1.

The method of FIG. 2 includes registering (202), by each management module, the management module's vehicle with the central database manager. Registering (202) the management module's vehicle with the central database manager may be carried out by providing the central database manager with a VIN for the vehicle or some other unique identification of the vehicle.

The method of FIG. 2 also includes maintaining (204), by the central database manager, static information describing each registered vehicle. Maintaining (204), by the central database manager, static information describing each registered vehicle may be carried out by retrieving static information describing the registered vehicles from various sources including, for example, vehicle manufacturer databases, auto parts sales websites, from the vehicle directly, and others.

The method of FIG. 2 also includes collecting (206), in real-time by each management module of a travelling vehicle, dynamic information describing the management module's vehicle. Collecting (206), in real-time, dynamic information describing the management module's vehicle may be carried out by collecting sensor information such as tire pressure sensor data, the vehicle's speed, the vehicle's location, the vehicles travelling direction, the number and location within the vehicle of passengers, and so on.

The method of FIG. 2 also includes establishing (208), by management modules of a set of traveling vehicles having a location within a predefined area, a collision zone that includes a data communications network of the management modules of the traveling vehicles. Establishing (208), by management modules of a set of traveling vehicles having a location within a predefined area, a collision zone may be carried out in various ways including a handshake procedure via a data communications network between management modules in which the management modules exchange location data, current travelling direction, and vehicle identification. Then, each management module may determine whether the other management module's vehicle is within a predefined area. In some embodiments, the data communications network is implemented with limited range wireless communications such that only vehicles within the range of the communications are included in the collision zone.

The method of FIG. 2 also includes sharing (210), amongst the management modules of the collision zone, dynamic information describing the traveling vehicles. Sharing (210) dynamic information describing the traveling vehicles may be carried out in various ways including, for example, by providing dynamic information followed by an update for any change in dynamic information.

The method of FIG. 2 also includes retrieving (212), by each of the management modules of the collision zone from the central database manager, static information describing the traveling vehicles. Retrieving (212) static information describing the traveling vehicles from the central database manager may be carried out by requesting information describing a particular VIN of one of the traveling vehicles in the collision zone.

The method of FIG. 2 also includes detecting (214), by a management module of a first traveling vehicle in the collision zone, a potential collision with a second traveling vehicle in the collision zone in dependence upon the dynamic and static information describing the first and second traveling vehicle. Detecting (214), by a management module of a first traveling vehicle in the collision zone, a potential collision may be carried out in various ways depending on the available data. For example, speed, direction and location of one vehicle may be utilized to calculate possibility, time, and severity of impact. Various heuristics may be utilized along with current weather conditions, street conditions, driver's present and historical conditions, and the like to infer a potential collision.

The method of FIG. 2 also includes controlling (216), by the management module of the first traveling vehicle, the first traveling vehicle to take evasive action in dependence upon the dynamic and static information describing the first and second traveling vehicle. Controlling (216) the first traveling vehicle to take evasive action may be carried out by altering the course of the vehicle, altering the speed of the vehicle through acceleration or braking, or otherwise controlling vehicle operations. In the method of FIG. 2, controlling (216) the first traveling vehicle to take evasive action may be carried out by controlling (216) the first traveling vehicle to avoid a collision with the second traveling vehicle; controlling (220) the first traveling vehicle to alert a driver of the first traveling vehicle of the potential collision; or controlling (222) the first traveling vehicle to reduce effects of a collision with the second traveling vehicle.

In the example of FIG. 2, controlling (222) the first traveling vehicle to reduce effects of a collision with the second traveling vehicle may include selecting an impact zone for the unavoidable collision. Although such a selection of impact zone is described here as being carried out by a management module of only the first traveling vehicle, readers of skill in the art will recognize that the management module of the first and second travelling vehicle may make a similar selection either independently or collectively. In all cases, any vehicle making a selection of impact zone or otherwise controlling a vehicle to reduce effects of a collision carries out such selection or control based on the static and dynamic information describing the vehicles that will be involved in the collision.

Figure 3:
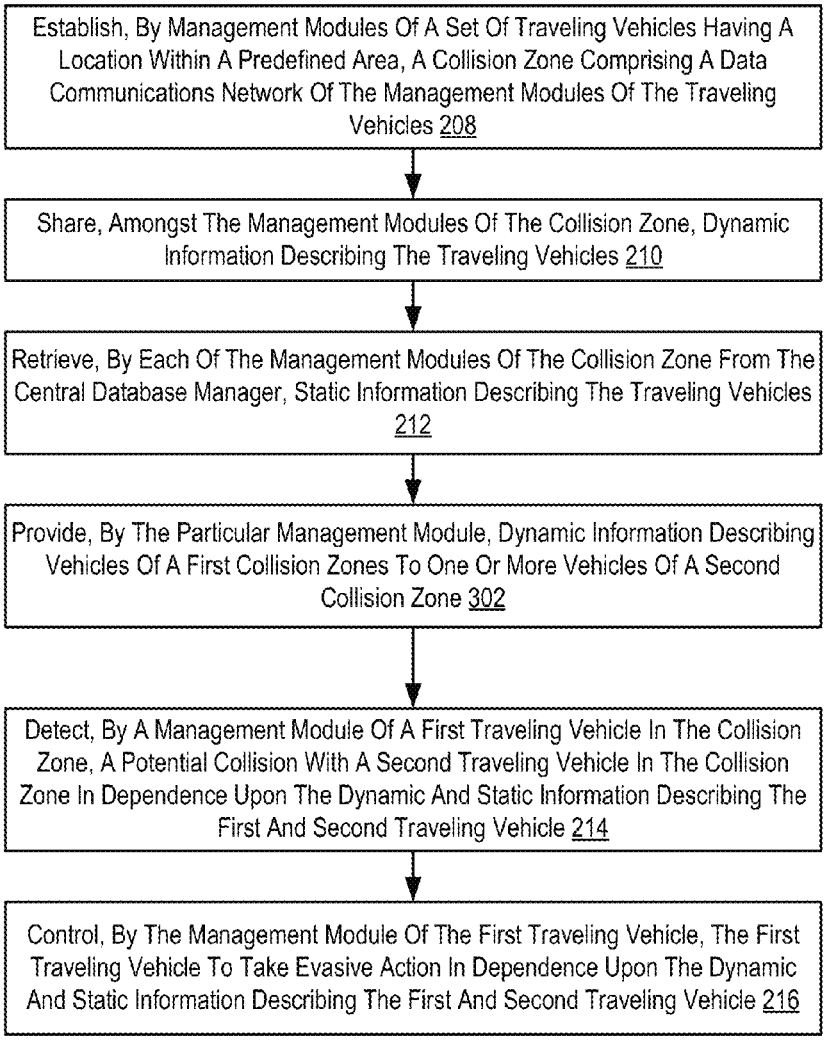
FIG. 3 sets forth a flow chart illustrating another example method for collision avoidance among vehicles according to embodiments of the present invention.

For further explanation, FIG. 3 sets forth a flow chart illustrating another example method for collision avoidance among vehicles according to embodiments of the present invention. Like the method of FIG. 2, each vehicle includes a management module coupled, for data communications, to other management modules and to a central database manager. Also like the method of FIG. 2, the method of FIG. 3 includes establishing (208) a collision zone, sharing (210) dynamic information amongst the vehicles of the collision zone, retrieving (212) static information describing the traveling vehicles from the central database manager, detecting (214) a potential collision of a first and second vehicle; and controlling (216), the first traveling vehicle to take evasive action.

The method of FIG. 3 differs from the method of FIG. 2, however, in that in the method of FIG. 3 a particular one of the management modules of one of the traveling vehicles is included in multiple collision zones. In such an embodiment, the method of FIG. 3 includes providing (302), by the particular management module, dynamic information describing vehicles of a first collision zones to one or more vehicles of a second collision zone. In this way, the particular management module operates as a 'bridge' between two collision zones. Consider an example in which three vehicles are in a first collision zone, with each vehicle traveling the same direction and set one mile behind another vehicle. One particular vehicle (the last in the collision zone) may be included in a second collision zone with vehicles behind the particular vehicle. When a vehicle of the first collision zone located in front of the particular vehicle suddenly applies the brakes and comes to a stop, the particular vehicle may pass the information along to the vehicles of the second zone so that the management modules of those vehicles may utilize that dynamic information to take evasive action if necessary.

Figure 4:
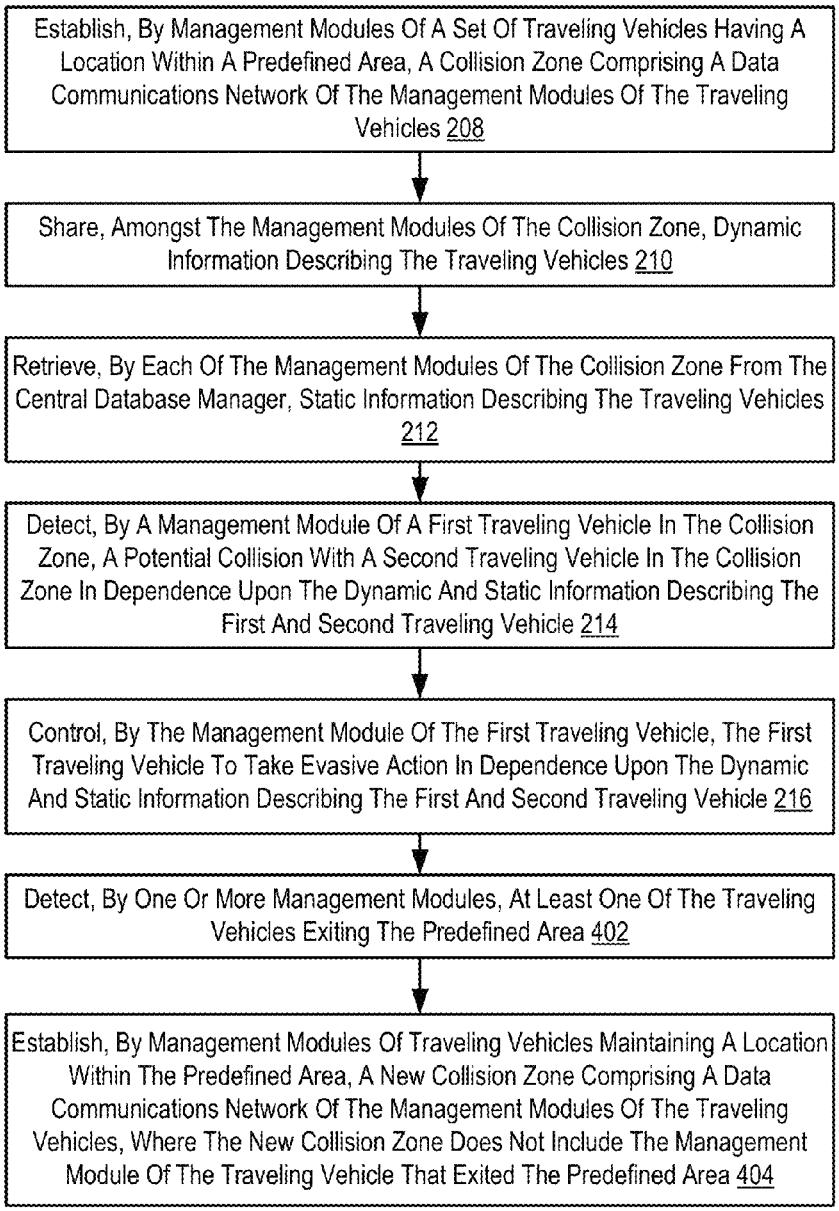
FIG. 4 sets forth a flow chart illustrating another example method for collision avoidance among vehicles according to embodiments of the present invention.

For further explanation, FIG. 4 sets forth a flow chart illustrating another example method for collision avoidance among vehicles according to embodiments of the present invention. Like the method of FIG. 2, each vehicle includes a management module coupled, for data communications, to other management modules and to a central database manager. Also like the method of FIG. 2, the method of FIG. 4 includes establishing (208) a collision zone, sharing (210) dynamic information amongst the vehicles of the collision zone, retrieving (212) static information describing the traveling vehicles from the central database manager, detecting (214) a potential collision of a first and second vehicle; and controlling (216), the first traveling vehicle to take evasive action.

FIG. 4 differs from the method of FIG. 3, however, in that the method of FIG. 4 includes detecting (402), by one or more management modules, at least one of the traveling vehicles exiting the predefined area. Detecting (402) at least one of the traveling vehicles exiting the predefined area of the collision zone may be carried out in various ways including receiving no communication from the exiting vehicle for a predefined period of time or calculating the trajectory of the exiting vehicle out of the predefined area based on location, speed, and direction.

The method of FIG. 4 also includes establishing (404), by management modules of traveling vehicles maintaining a location within the predefined area, a new collision zone that includes a data communications network of the management modules of the traveling vehicles, where the new collision zone does not include the management module of the traveling vehicle that exited the predefined area. That is, the collision zone may be reconfigured to remove the exited vehicle. Alternatively, any new vehicle entering the predefined area may cause a reconfiguration as well in a similar manner.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electro-magnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing.

Computer program code for carrying out operations for aspects of the present invention may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described above with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

The flowchart and block diagrams in the Figures illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

It will be understood from the foregoing description that modifications and changes may be made in various embodiments of the present invention without departing from its true spirit. The descriptions in this specification are for purposes of illustration only and are not to be construed in a limiting sense. The scope of the present invention is limited only by the language of the following claims.

What is claimed is:

1. A method of collision avoidance among vehicles, each vehicle comprising a management module coupled, for data communications, to other management modules and to a central database manager, the method comprising:

establishing, by management modules of a set of traveling vehicles having a location within a predefined area, a collision zone comprising a data communications network of the management modules of the traveling vehicles, wherein each management module of a traveling vehicle is included in at least one collision zone and a particular management module of one of the traveling vehicles is included in a plurality of collision zones;

sharing, amongst the management modules of the collision zone, dynamic information describing the traveling vehicles;

retrieving, by each of the management modules of the collision zone from the central database manager, static information describing the traveling vehicles;

detecting, by a management module of a first traveling vehicle in the collision zone, a potential collision with a second traveling vehicle in the collision zone in dependence upon the dynamic and static information describing the first and second traveling vehicle; and controlling, by the management module of the first traveling vehicle, the first traveling vehicle to take action in dependence upon the dynamic and static information describing the first and second traveling vehicle.

2. The method of claim 1 further comprising providing, by the particular management module, dynamic information describing vehicles of a first collision zones to one or more vehicles of a second collision zone.

3. The method of claim 1 further comprising:

detecting, by one or more management modules, at least one of the traveling vehicles exiting the predefined area;

establishing, by management modules of traveling vehicles maintaining a location within the predefined area, a new collision zone comprising a data communications network of the management modules of the traveling vehicles, wherein the new collision zone does not include the management module of the traveling vehicle that exited the predefined area.

4. The method of claim 1 wherein controlling the first traveling vehicle to take action further comprises one of:

controlling the first traveling vehicle to avoid a collision with the second traveling vehicle;

controlling the first traveling vehicle to alert a driver of the first traveling vehicle of the potential collision; and controlling the first traveling vehicle to reduce effects of a collision with the second traveling vehicle.

5. The method of claim 1 further comprising:

registering, by each management module, the management module's vehicle with the central database manager;

maintaining, by the central database manager, static information describing each registered vehicle; and collecting, in real-time by each management module of a travelling vehicle, dynamic information describing the management module's vehicle.

6. An apparatus for collision avoidance among vehicles, each vehicle comprising a management module coupled, for data communications, to other management modules and to a central database manager, the apparatus comprising a computer processor and a computer memory operatively coupled to the computer processor, the computer memory having disposed within it computer program instructions that, when executed by the computer processor, cause the apparatus to:

establish, by management modules of a set of traveling vehicles having a location within a predefined area, a collision zone comprising a data communications network of the management modules of the traveling vehicles, wherein each management module of a traveling vehicle is included in at least one collision zone and a particular management module of one of the traveling vehicles is included in a plurality of collision zones;

share, amongst the management modules of the collision zone, dynamic information describing the traveling vehicles;

retrieve, by each of the management modules of the collision zone from the central database manager, static information describing the traveling vehicles;

detect, by a management module of a first traveling vehicle in the collision zone, a potential collision with a second traveling vehicle in the collision zone in dependence upon the dynamic and static information describing the first and second traveling vehicle; and control, by the management module of the first traveling vehicle, the first traveling vehicle to take evasive action in dependence upon the dynamic and static information describing the first and second traveling vehicle.

7. The apparatus of claim 6 further comprising computer program instructions that, when executed by the computer processor, cause the apparatus to provide, by the particular management module, dynamic information describing vehicles of a first collision zones to one or more vehicles of a second collision zone.

8. The apparatus of claim 6 further comprising computer program instructions that, when executed by the computer processor, cause the apparatus to:

detect, by one or more management modules, at least one of the traveling vehicles exiting the predefined area;

establish, by management modules of traveling vehicles maintaining a location within the predefined area, a new collision zone comprising a data communications network of the management modules of the traveling vehicles, wherein the new collision zone does not include the management module of the traveling vehicle that exited the predefined area.

9. The apparatus of claim 6 wherein controlling the first traveling vehicle to take action further comprises one of:

controlling the first traveling vehicle to avoid a collision with the second traveling vehicle;

controlling the first traveling vehicle to alert a driver of the first traveling vehicle of the potential collision; and controlling the first traveling vehicle to reduce effects of a collision with the second traveling vehicle.

10. The apparatus of claim 6 further comprising computer program instructions that, when executed by the computer processor, cause the apparatus to:

register, by each management module, the management module's vehicle with the central database manager;

maintain, by the central database manager, static information describing each registered vehicle; and collect, in real-time by each management module of a travelling vehicle, dynamic information describing the management module's vehicle.

11. A computer program product for collision avoidance among vehicles, each vehicle comprising a management module coupled, for data communications, to other management modules and to a central database manager, the computer program product disposed upon a computer readable storage medium, wherein the computer readable storage medium is not a signal, the computer program product comprising computer program instructions that, when executed, cause a computer to carry out the steps of:

establishing, by management modules of a set of traveling vehicles having a location within a predefined area, a collision zone comprising a data communications network of the management modules of the traveling vehicles, wherein each management module of a traveling vehicle is included in at least one collision zone and a particular management module of one of the traveling vehicles is included in a plurality of collision zones;

sharing, amongst the management modules of the collision zone, dynamic information describing the traveling vehicles;

retrieving, by each of the management modules of the collision zone from the central database manager, static information describing the traveling vehicles;

detecting, by a management module of a first traveling vehicle in the collision zone, a potential collision with a second traveling vehicle in the collision zone in dependence upon the dynamic and static information describing the first and second traveling vehicle; and controlling, by the management module of the first traveling vehicle, the first traveling vehicle to take evasive action in dependence upon the dynamic and static information describing the first and second traveling vehicle.

12. The computer program product of claim 11 further comprising computer program instructions that, when executed, cause a computer to carry out the step of providing, by the particular management module, dynamic information describing vehicles of a first collision zones to one or more vehicles of a second collision zone.

13. The computer program product of claim 11 further comprising computer program instructions that, when executed, cause a computer to carry out the steps of:

detecting, by one or more management modules, at least one of the traveling vehicles exiting the predefined area;

establishing, by management modules of traveling vehicles maintaining a location within the predefined area, a new collision zone comprising a data communications network of the management modules of the traveling vehicles, wherein the new collision zone does not include the management module of the traveling vehicle that exited the predefined area.

14. The computer program product of claim 11 wherein controlling the first traveling vehicle to take action further comprises one of:

controlling the first traveling vehicle to avoid a collision with the second traveling vehicle;

controlling the first traveling vehicle to alert a driver of the first traveling vehicle of the potential collision; and controlling the first traveling vehicle to reduce effects of a collision with the second traveling vehicle.

15. The computer program product of claim 11 further comprising computer program instructions that, when executed, cause a computer to carry out the steps of:

registering, by each management module, the management module's vehicle with the central database manager;

maintaining, by the central database manager, static information describing each registered vehicle; and collecting, in real-time by each management module of a travelling vehicle, dynamic information describing the management module's vehicle.

* * * * *